US006138604A

United States Patent [19]

Anderson et al.

[11] Patent Number: 6,138,604

[45] Date of Patent: Oct. 31, 2000

[54] PELAGIC FREE SWINGING AQUATIC VEHICLE

[75] Inventors: Jamie M. Anderson, Watertown; Peter A. Kerrebrock, Hingham; Peter W. Sebelius, Chelmsford, all of Mass.

[73] Assignee: The Charles Stark Draper Laboratories, Inc., Cambridge, Mass.

[21] Appl. No.: 09/085,256

[22] Filed: May 26, 1998

[51] Int. Cl.[7] ..... B63G 8/18

[52] U.S. Cl. ..... 114/332; 440/15; 114/337

[58] Field of Search ..... 114/312, 333, 114/337, 313, 332, 144 R, 126; 440/14, 15

[56] References Cited

U.S. PATENT DOCUMENTS

| | | | |
|---|---|---|---|
| 2,936,729 | 5/1960 | Kuttner | 440/15 |
| 3,463,108 | 8/1969 | Neumeier | 114/333 |
| 5,401,196 | 3/1995 | Triantafyllou et al. . | |

OTHER PUBLICATIONS

Triantafyllou et al., "An Efficient Swimming Machine", Scientific American, Mar. 1995, pp. 40–48.

Kumph, John Muir, "The Design of a Free Swimming Robot Pike", Theisis, Massachusetts Institute of Technology, May 1996.

Patton, Phil, Magazine of International Design, v.40, n.6, pp. 57–61 (Nov. 1996).

Anderson et al., "Concept Design of a Flexible–Hull Unmanned Undersea Vehicle", Draper Lanboratory, May 25–30 1997.

*Primary Examiner*—Stephen Avila

*Attorney, Agent, or Firm*—Iandiorio & Teska

[57] ABSTRACT

A pelagic free swimming aquatic vehicle includes a rigid forebody having a predetermined volume; a watertight chamber in the forebody; and a flexible afterbody having a lesser volume than the forebody and including a maneuvering and propulsion propulsion structure and a drive system for driving the structure with a traveling sinusoidal wave motion.

24 Claims, 14 Drawing Sheets

10
12
14
16
8A
8B
8C
8D
LONGITUDINAL VOLUME DISTRIBUTION
LONGITUDINAL WEIGHT DISTRIBUTION
150
160
164
100%
70%
50%
CUMULATIVE VOLUME
VOLUME
WEIGHT
LENGTH

PELAGIC FREE SWINGING AQUATIC VEHICLE

FIELD OF INVENTION

This invention relates to a pelagic free swimming aquatic vehicle.

BACKGROUND OF INVENTION

Much work has been done to study and imitate free swimming fish to try to effect a man-made free moving aquatic vehicle which approaches their propulsion efficiency, acceleration and maneuverability.

The MIT Robotuna (Scientific American, March, 1995), is a 49-inch long biologically inspired animated tow tank test platform model built to study swimming efficiency and how it relates to body kinematics. The body shape and flexibility mimics the yellowfin tuna, a fast swimming pelagic fish similar in shape and kinematics to the renowned bluefin tuna. Robotuna was meant to be flexible in that the design allows extreme body motion combinations well beyond the capabilities of a real tuna, enabling complete access to the swimming parameter space. The robot is comprised of six cable driven links which can be independently actuated. Each link is driven by a cable which runs via pulleys through the body and mast to a stepping motor mounted out of the water on the tow tank carriage.

The Robotuna was exercised in the MIT Ocean Engineering Testing Tank by prescribing a set of kinematic parameters (angular deflections of each joint, tow speed, jsi phase relationships) and measuring the net power transmitted to the linkages and the reaction force between the tuna and carriage.

The Robotuna is not a vehicle; it is a test platform. It does not contain pressure hulls, on-board electronics, power (such as batteries) or actuators. All of the body is actuated to some degree, either passively or actively, through the support structure that suspends it in the tank. There are sufficient number of links to adequately reproduce the required travelling sinusoidal wave for straight propulsion. The robot can bend into turning shapes but cannot turn or accelerate freely due to the fixed attachment to the towing carriage.

A later effort, Robopike (John Kumph, MIT B.S. thesis, May, 1996) is intended as a testbed for maneuvering and fast starting research. Unlike its carriage slaved predecessor, the Robopike will swim freely under radio control. The design is considerably smaller and simpler than the Robotuna to allow for packaging of all the actuators inside the body. The design was based on the actual size and form of a pike, a fish species renowned for fast acceleration and maneuvering.

Edge Innovations has built several aquatic animatronics robots for the motion picture industry. Apparently several models were built: a rubber dummy whale, a remotely operated whale with thrusters (propellers), and a remotely operated whale with hydraulic actuators (offboard hydraulic system). None are believed to be autonomous; Flipper was apparently a motor operated robot with unknown degrees of freedom and architecture. The Star Trek humpback whale was apparently a motor-operated whale with two degrees of freedom, one motor for up/down tail motion and one for side to side tail motion, all of which was encased in a urethane material to simulate the texture of a real whale. It is unclear from the limited literature/video available whether or not these robots contain pressure hulls. In the entertainment industry, animatronic robots are built for show only and do not contain the system elements necessary for an oceangoing vehicle (onboard power, actuation, control, payload, etc.). Work continues at MIT on Robopike. At Northeastern University there is work on an articulated testbed lamprey eel which is remotely operated, but has no pressure hull and no external body. The University of Tokai, Japan, Kato Lab has produced a Black Bass Robot remotely operated vehicle using pectoral fins for propulsion. There are no pressure hulls or onto board power. Motors provide pectoral fm movements. The Herriot-Watt University, Edinburgh, Scotland web site shows FLAPS (Flexible Appendage for Positioning and Stabilisation) for a fish-like propulsor with a tuna shaped vehicle picture with a foil attached to the end. Texas A&M University and Aeroprobe Corp. have shown work on a shape memory alloy test platform which is not a vehicle but resembles a fish. They articulate the aft 15–20% of the foil shaped body. The University of New Mexico and Artificial Muscles Research Institute are researching ion exchange polymer metal composite as biomimetic actuators. They show an autonomous "robotic swimmer" which has the form of a small boat with a tadpole like beam tail which oscillates. It is very small (6 inches) with an oscillating section roughly 20% of the total length.

SUMMARY OF INVENTION

It is therefore an object of this invention to provide an improved pelagic free swimming aquatic vehicle.

It is a further object of this invention to provide such a pelagic free swimming aquatic vehicle which is autonomous.

It is a further object of this invention to provide such a pelagic free swimming aquatic vehicle which articulates a portion of its body for both propulsion and maneuvering.

It is a further object of this invention to provide such a pelagic free swimming aquatic vehicle which achieves traveling sine wave motion and large amplitude turning flexures.

It is a further object of this invention to provide such a pelagic free swimming aquatic vehicle which employs a rigid forebody and articulate afterbody for propulsion.

It is a further object of this invention to provide such a pelagic free swimming aquatic vehicle in which the forebody includes dry space for an energy source or payload.

It is a further object of this invention to provide such a pelagic free swimming aquatic vehicle in which the forebody includes a pressure hull.

It is a further object of this invention to provide such a pelagic free swimming aquatic vehicle which is capable of out of plane movement such as diving.

The invention results from the realization that a truly effective pelagic free swimming aquatic vehicle which is highly maneuverable and efficiently propelled can be achieved with a rigid forebody having a predetermined volume with a water tight chamber and a flexible afterbody having a lesser volume than the forebody and including a maneuvering and propulsion structure and a drive system for driving said structure with a traveling sinusoidal wave motion.

This invention features a pelagic free swimming aquatic vehicle including a rigid forebody having a predetermined volume and a watertight chamber in the forebody. There is a flexible afterbody having a lesser volume than the forebody and including a maneuvering and propulsion structure and a drive system for driving the structure with a traveling sinusoidal wave motion.

In a preferred embodiment the volume of the forebody may be 50%–70% of the envelope displacement of the vehicle. The longitudinal weight distribution may follow the longitudinal volume distribution in the vehicle. The chamber may be a pressure hull and it may include a cargo volume. The chamber may include an energy source and the energy source may include a battery, a fuel cell or air independent thermal engine. The afterbody may have neutral buoyancy. The propulsion structure may include an outer water impervious medium. The structure may include at least one longitudinal element and a plurality of laterally extending elements attached to each of the longitudinal elements for maintaining a fair contour during bending due to propulsion or maneuvering. The structure may include an intermediate medium between the outer medium and the lateral elements for preventing cupping of the outer medium between the lateral elements. The drive system may include a plurality of sequentially pivotally interconnected links and the hydraulic drive means for moving each of the links relative to its adjacent links. The length of the forebody may be 40–80% of the combined length of the forebody and afterbody. The vehicle may include diving plane means for controlling depth and pitch. The diving plane means may include a pair of diving planes. The nose of the forebody may be flexible and there may be a drive mechanism for steering the flexible nose. The chamber may include a control system having means for directing the drive system to drive the structure with a traveling sinusoidal wave motion. The control system may include means for directing the drive system to drive the structure to assume a curved shape.

DISCLOSURE OF PREFERRED EMBODIMENT

Other objects, features and advantages will occur to those skilled in the art from the following description of a preferred embodiment and the accompanying drawings, in which.

Figure 1:
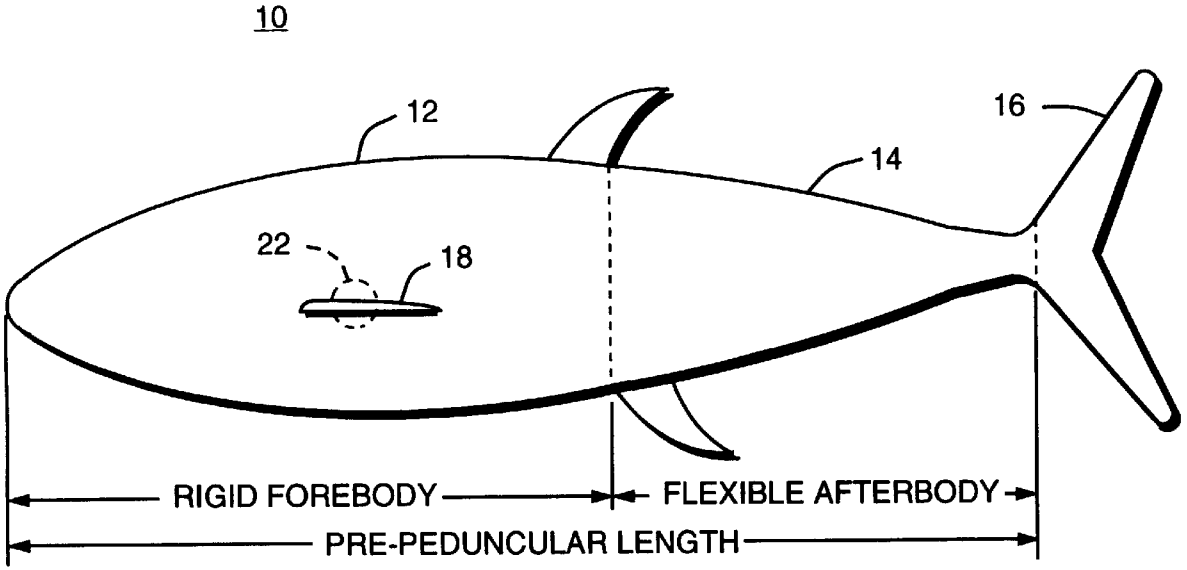
FIG. 1 is a diagrammatic side elevational view of a pelagic free swimming aquatic vehicle according to this invention.
Figure 8D:
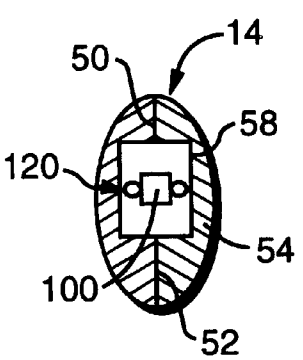
Figure 8C:
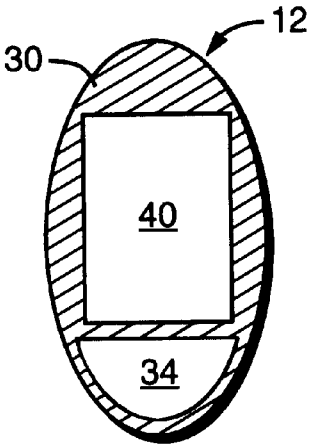
Figure 8B:
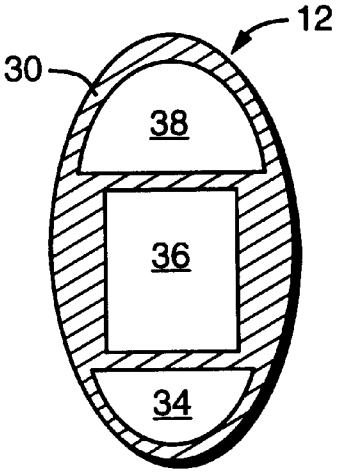
Figure 8A:
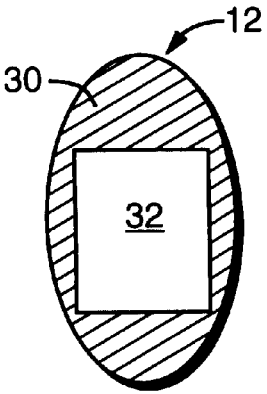
Figure 8E:
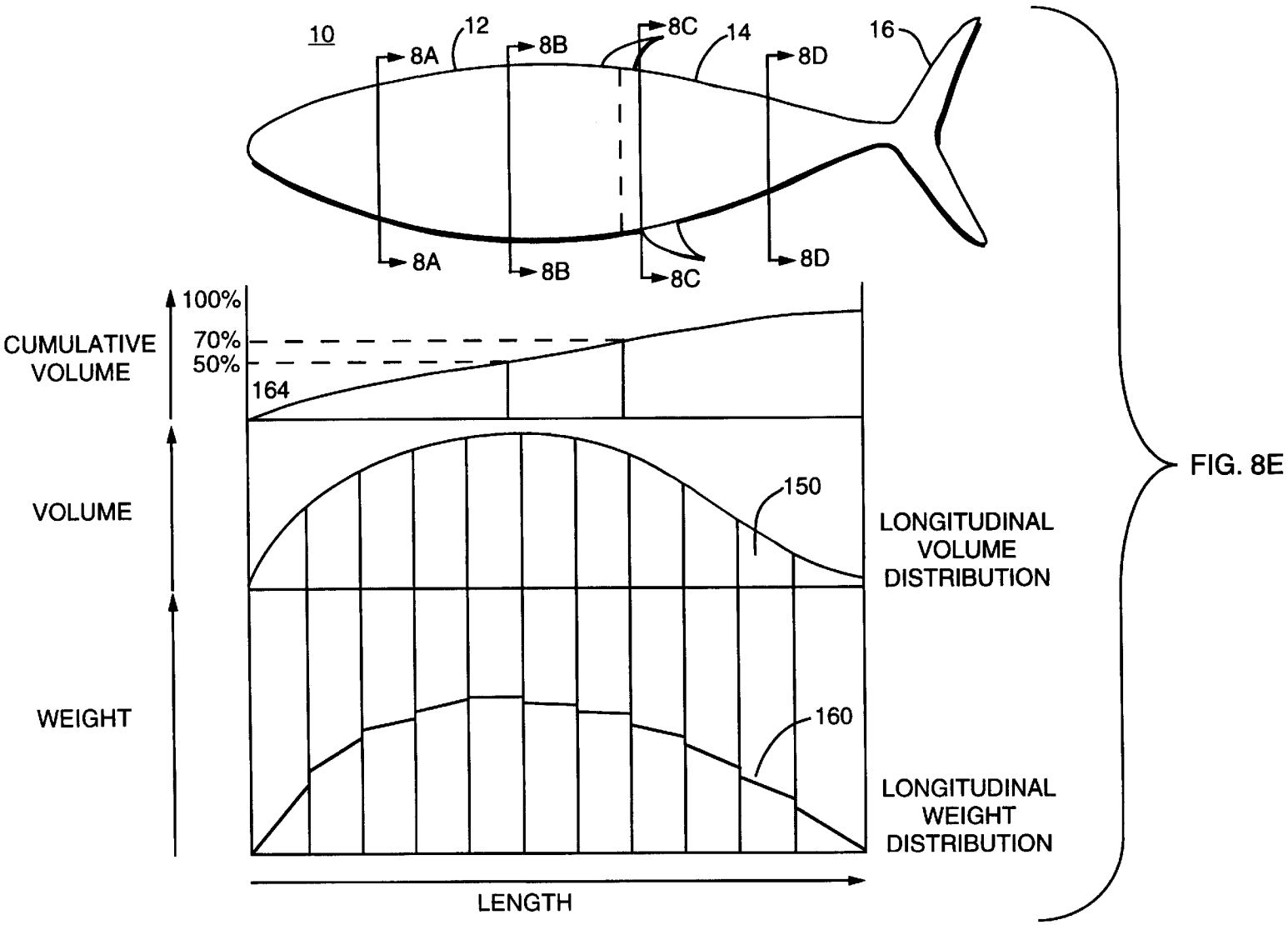
Figure 9:
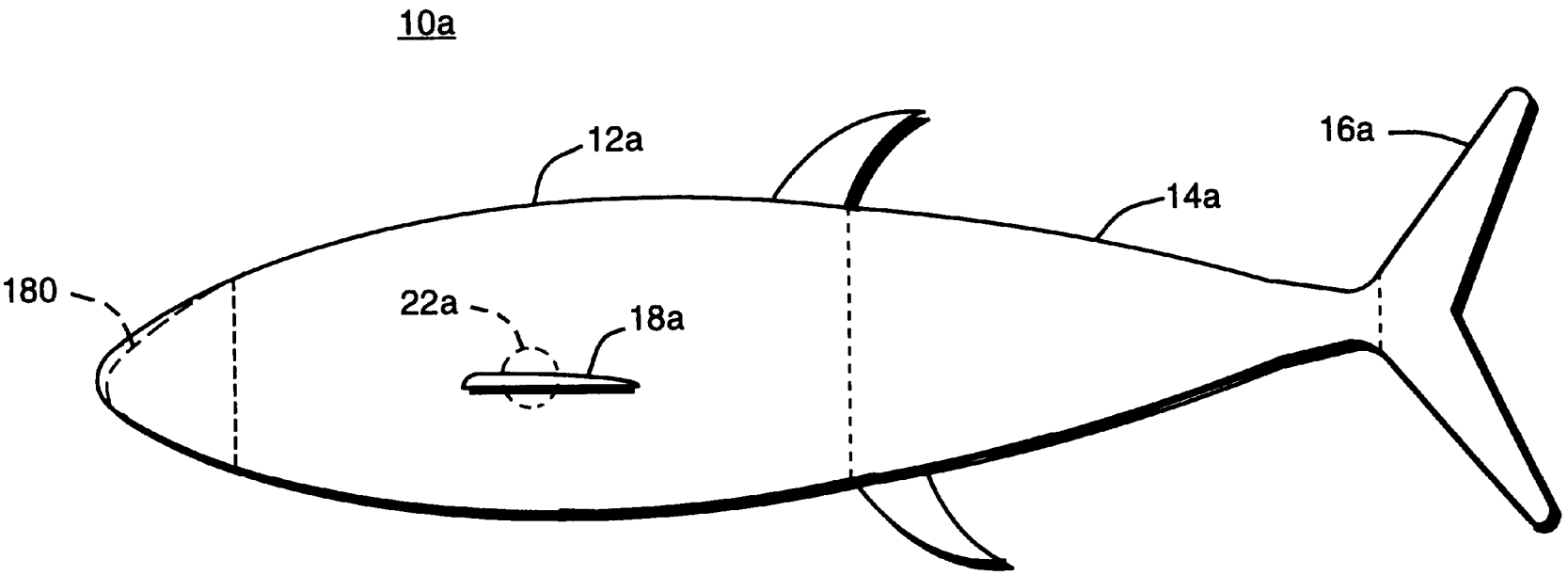
Figure 10:
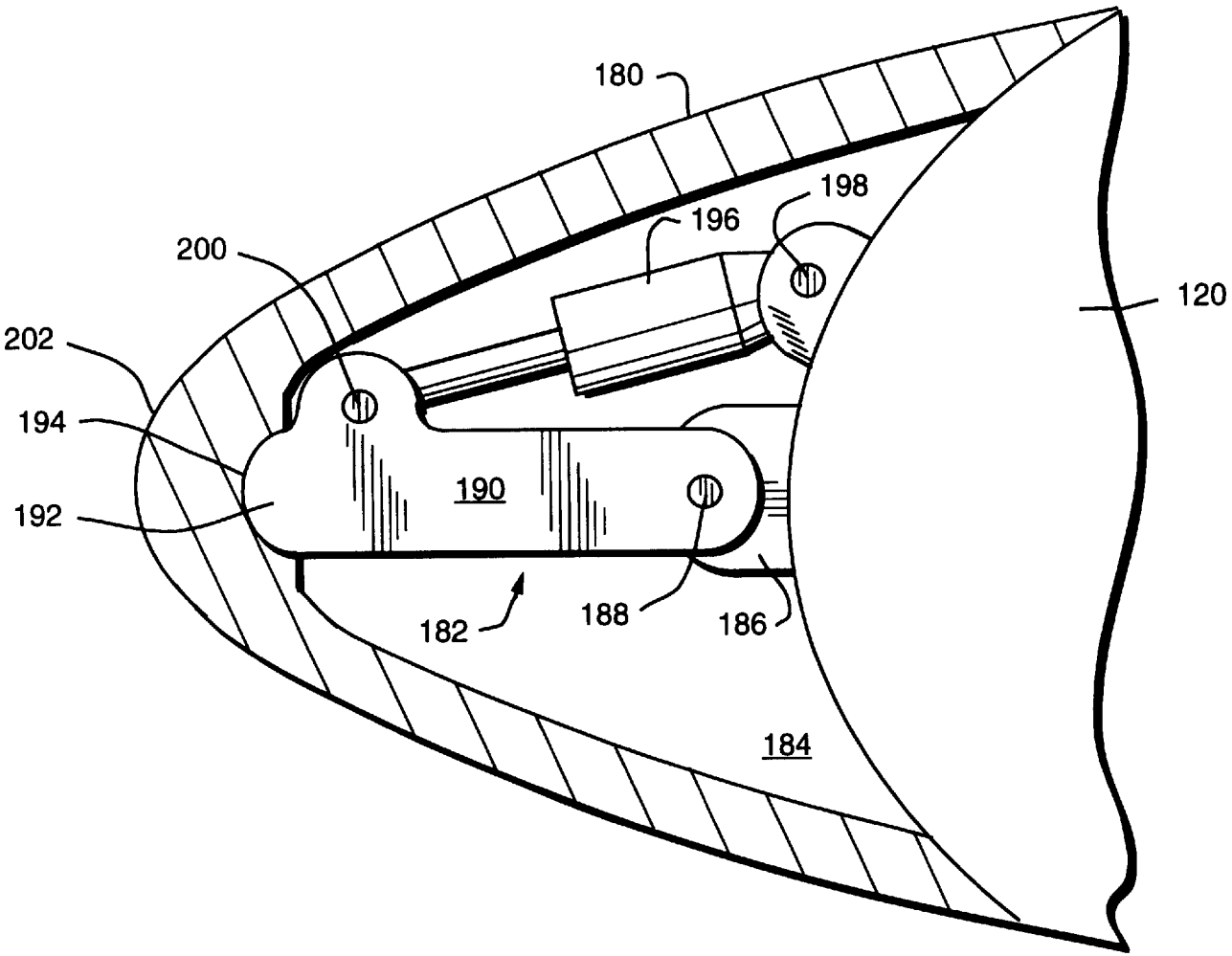
Figure 11C:
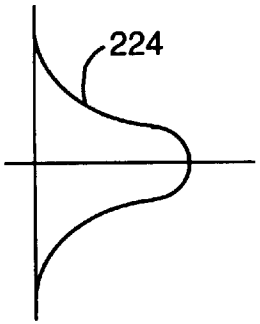
Figure 11A:
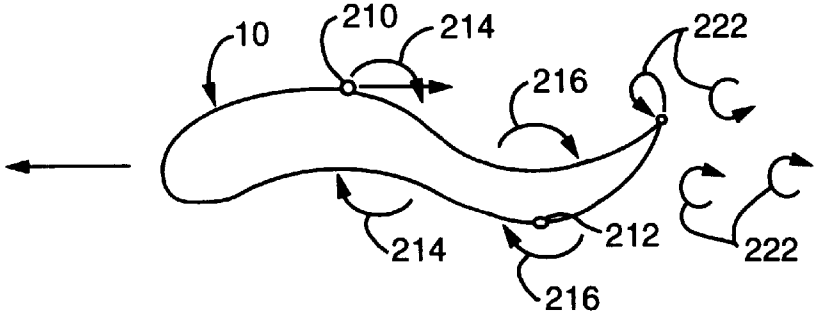
Figure 12:
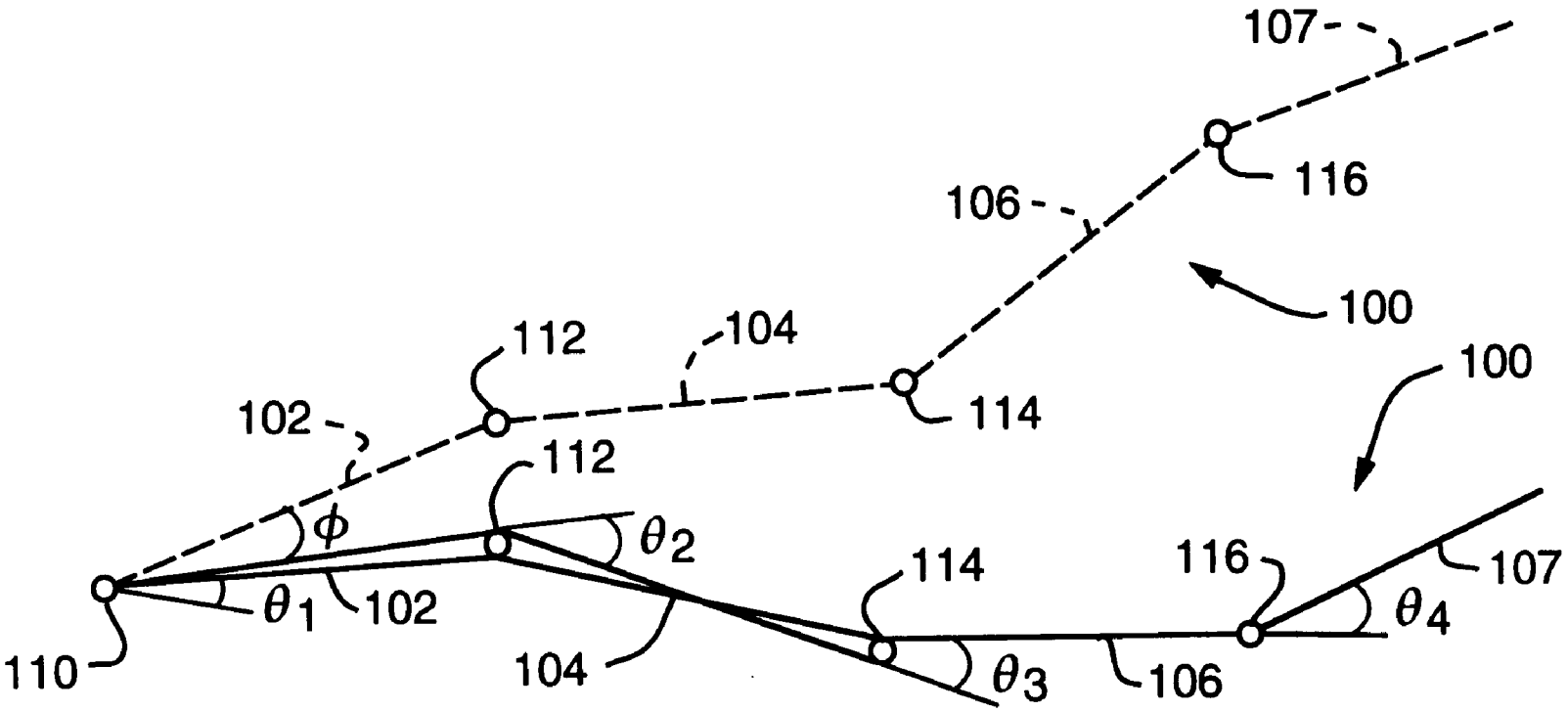
Figure 13:
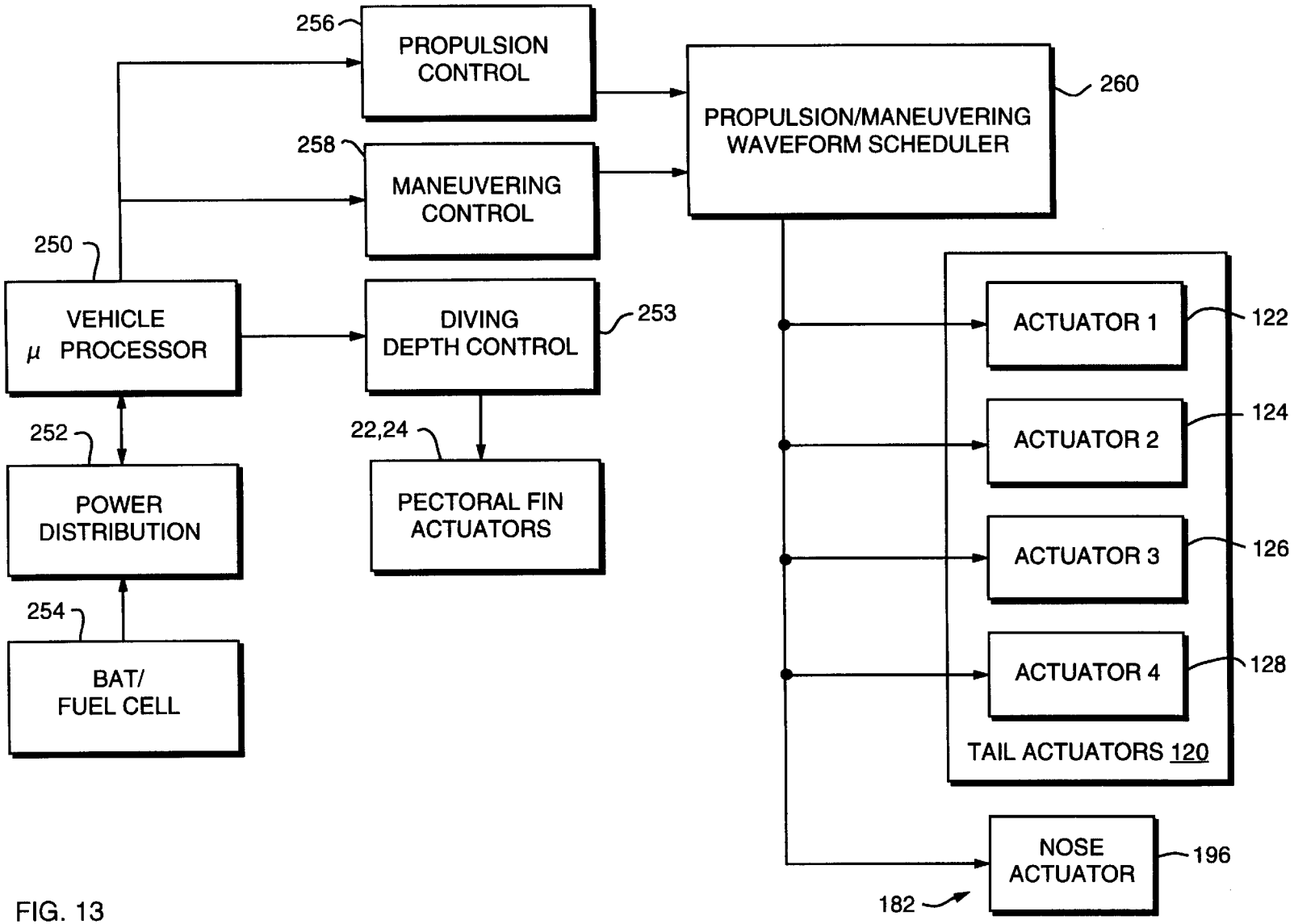
Figure 14:
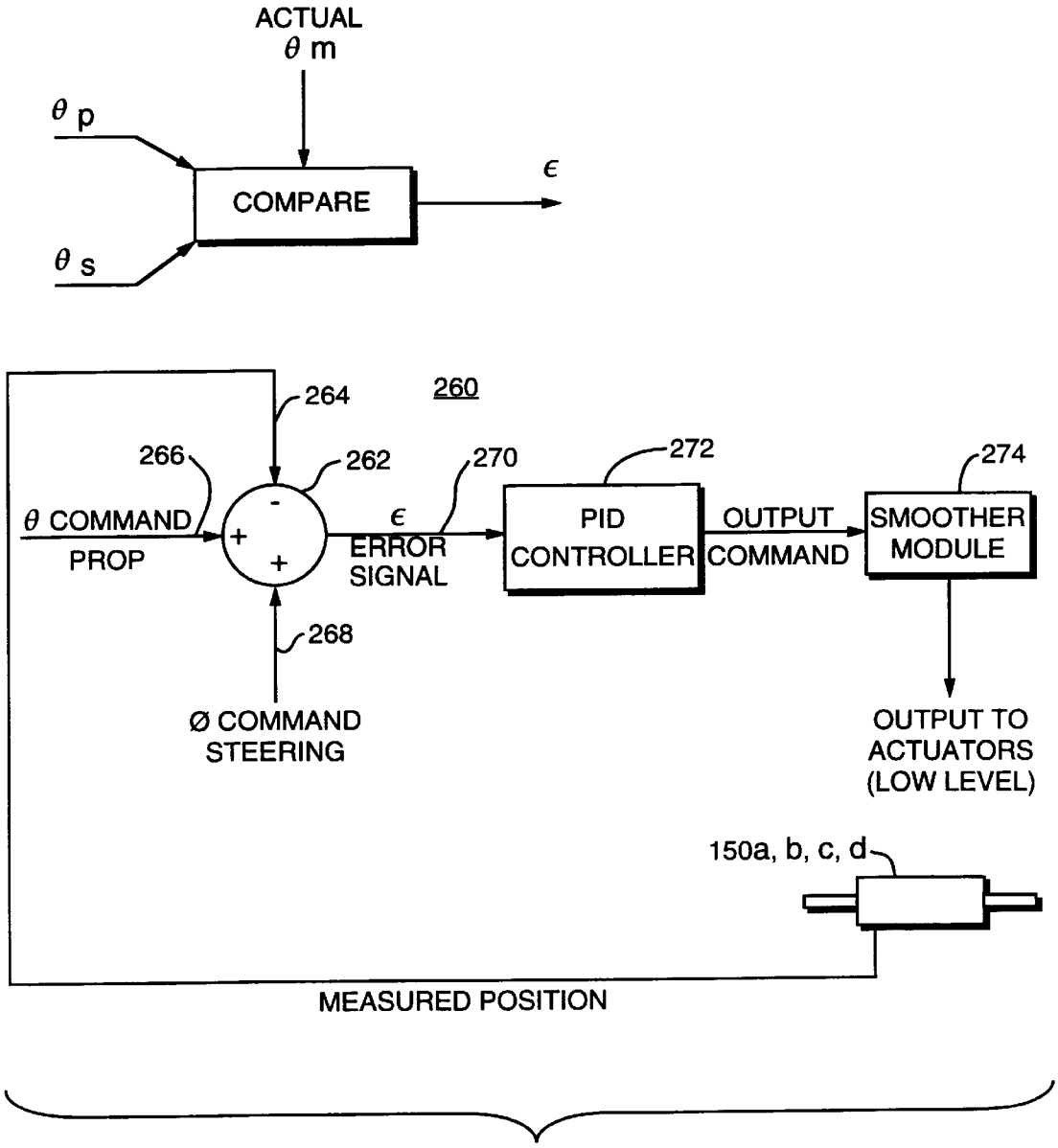
Figure 15:
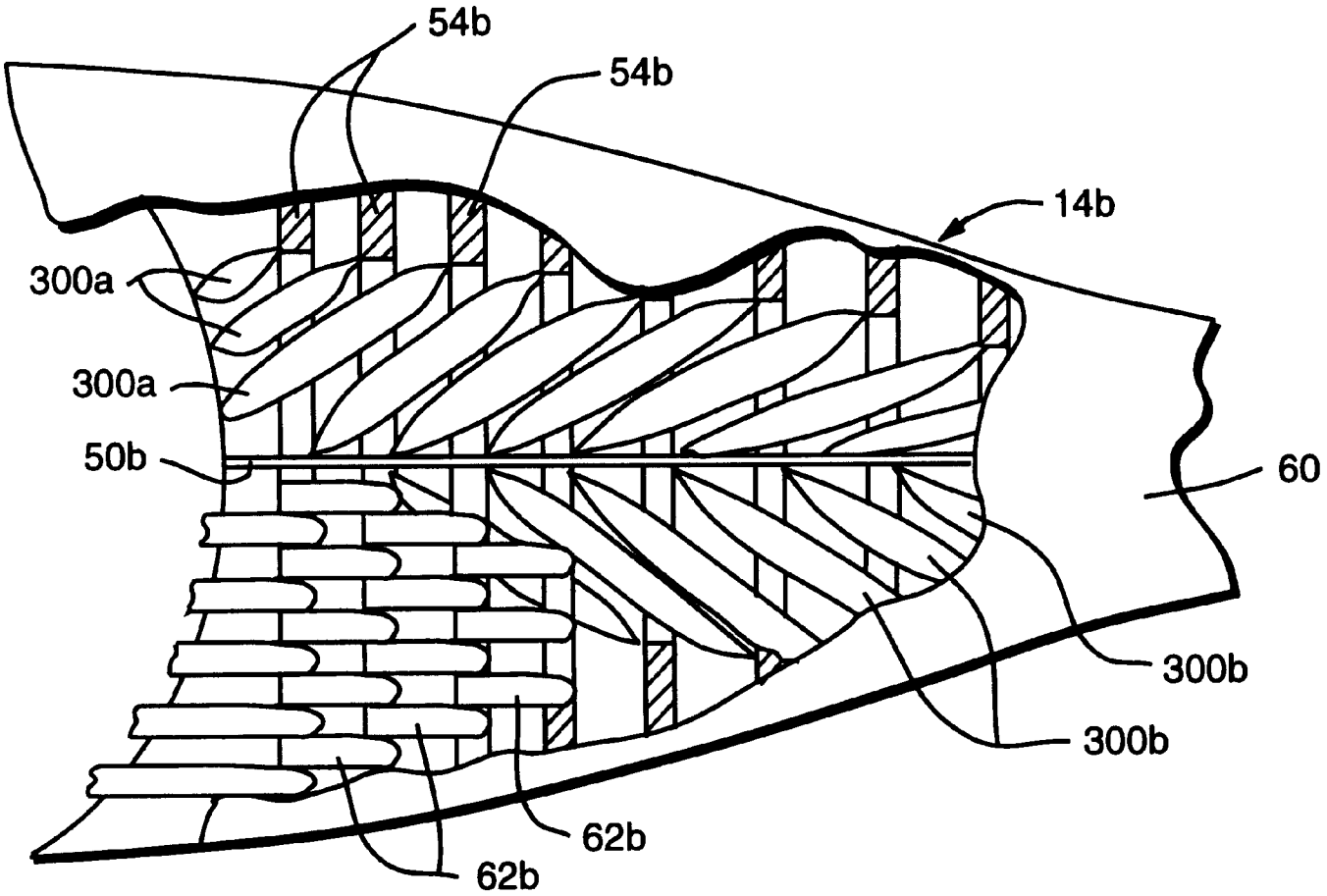

FIGS. 8A, B, C and D are sectional views taken along lines 8A—8A, 8B—8B, 8C—8C and 8D—8D of FIG. 8E;

FIG. 8E shows a simplified drawing of the vehicle of FIG. 1 accompanied by the waveforms showing cumulative volume and weight along the length of the vehicle;

FIG. 9 is a view similar to FIG. 1 of the vehicle according to this invention with the addition of a flexible nose;

FIG. 10 is an enlarged view of a structure that can be used to articulate the flexible nose;

FIGS. 11A and B are diagrammatic views showing the traveling sinusoidal wave motion along the body of the vehicle and the vortices created thereby;

FIG. 11C shows the velocity profile or jet flow produced by the motion depicted in FIGS. 11A and B;

FIG. 12 is a schematic drawing showing in full lines the angular displacement of each link relative to the adjacent links to produce a traveling wave motion and in the dashed lines is shown a similar traveling sinusoidal wave motion imposed on the structure when it has been curved for maneuvering;

FIG. 13 is a schematic block diagram showing the control and drive systems for operating the vehicle according to this invention;

FIG. 14 is a functional block diagram of the propulsion/maneuvering waveform scheduler of FIG. 13, and FIG. 15 is a top plan view with portions broken away of an alternative embodiment of the afterbody using artificial muscles to impart the motion.

Figure 2:
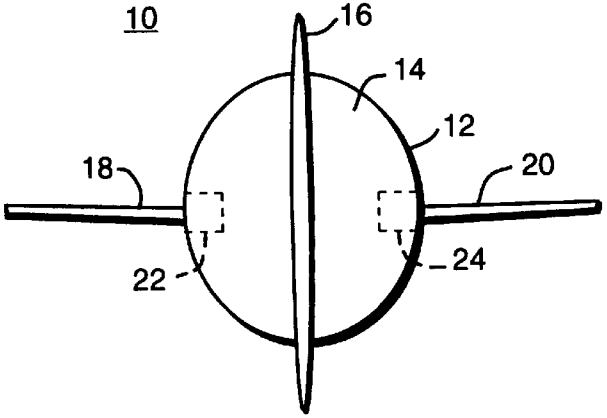
FIG. 2 is an end view of the vehicle of FIG. 1.
Figure 3:
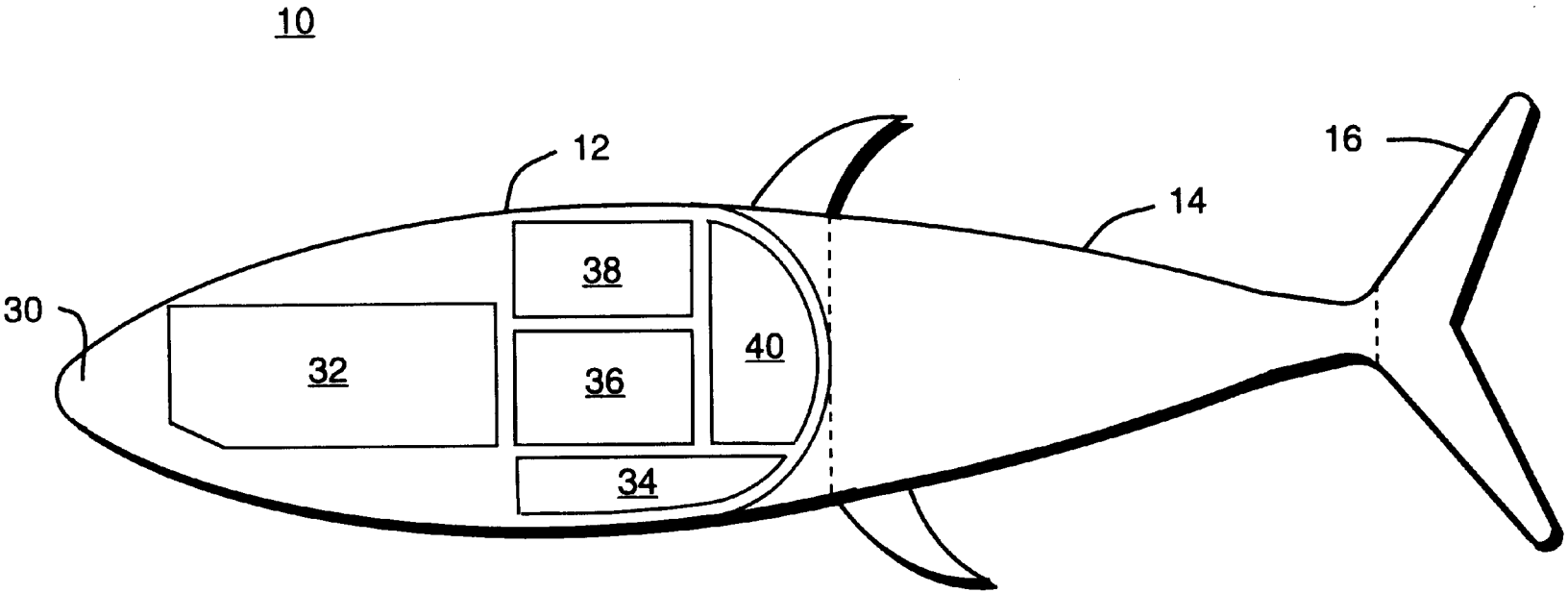
FIG. 3 is a view similar to FIG. 1 with portions of the forebody broken away to show the watertight chamber and its contents.

There is shown in FIG. 1 a pelagic free swimming aquatic vehicle 10 according to this invention including a rigid forebody 12, flexible afterbody 14, and tail 16. The rigid forebody 12 and flexible afterbody 14 comprise the prepeduncular length of the vehicle which excludes tail 16. Dive planes 18, 20, FIG. 2, may be provided for out-of-plane steering and depth control. Servo motors 22 and 24 are used to drive dive planes 18 and 20, respectively. Forebody 12 includes a watertight chamber 30 and has a volume which is greater than the volume of afterbody 14. Typically forebody 12 is 50–70% of the envelope displacement of the vehicle. Watertight chamber or compartment 30 has a pressure hull to enable it to withstand pressures encountered in deep diving. Chamber 30 has space for an energy source 32 such as a battery, fuel cell or air independent thermal engine, ballast 34, payload or cargo 36, operating system 38, and a portion of the propulsion drive system 40.

Figure 4:
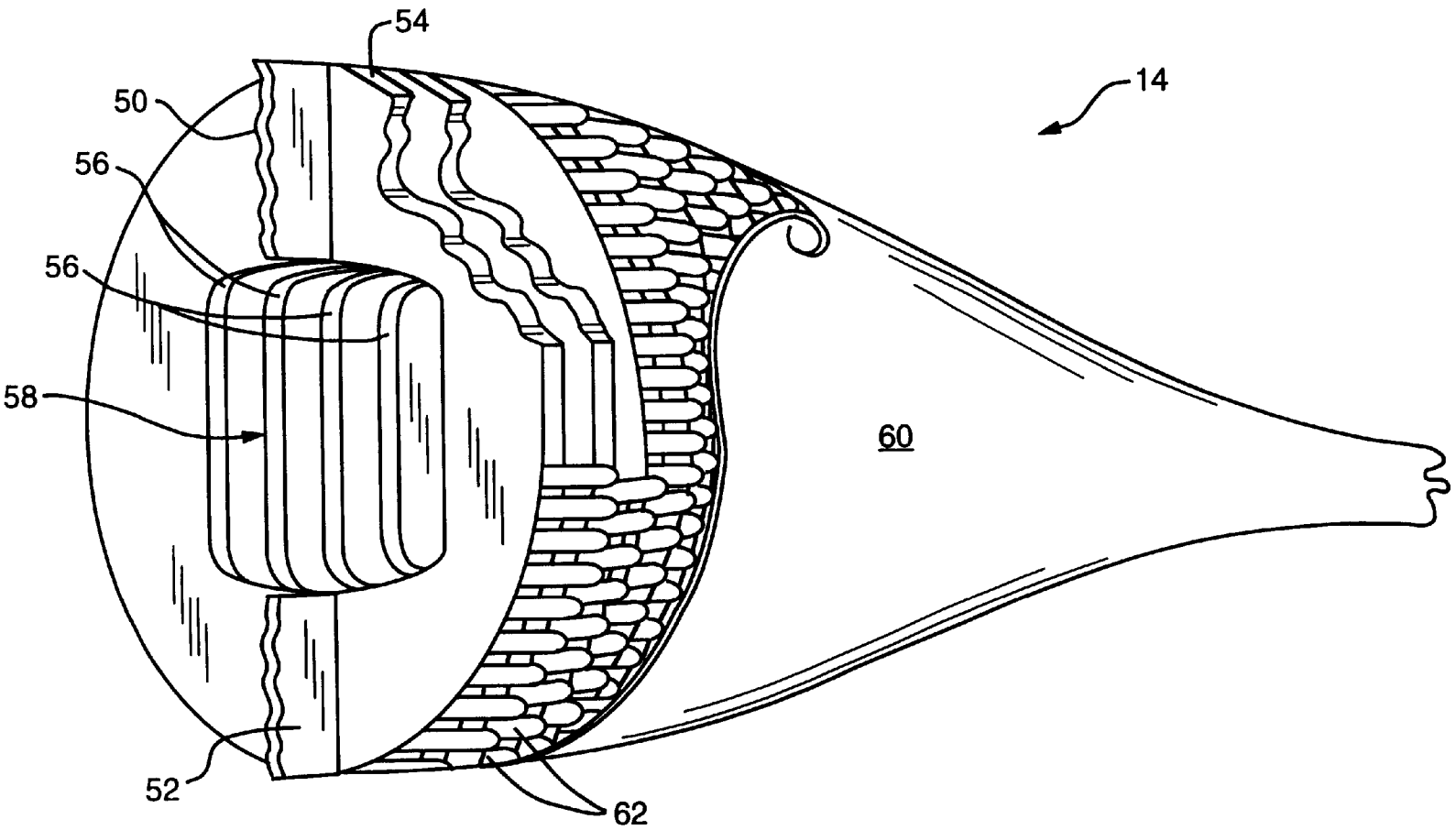
FIG. 4 is a three-dimensional partially broken away view of the afterbody of FIG. 1 showing the flexible batten and buoyant foam structure with the intermediate sliding plates and flexible skin.

Afterbody 14 may be made up of one or more flexible longitudinal battens 50 and 52, FIG. 4, to which are attached a plurality of buoyant foam plates 54 of varying shape to define the shape of the body. Plates 54 contain central holes 56 which define a hollow central core 58 in which the drive structure and drive system are disposed, as will be explained with respect to FIG. 7. The entire structure is covered by a flexible skin 60 and there may be an intermediate layer of sliding plates 62. The flexible battens may be made of fiberglass, the buoyant foam plates may be rigid closed cell PVC foam, the flexible skin may be neoprene rubber and the sliding plates may be fiberglass or metal. These are examples only and any suitable material may be used.

Figure 5:
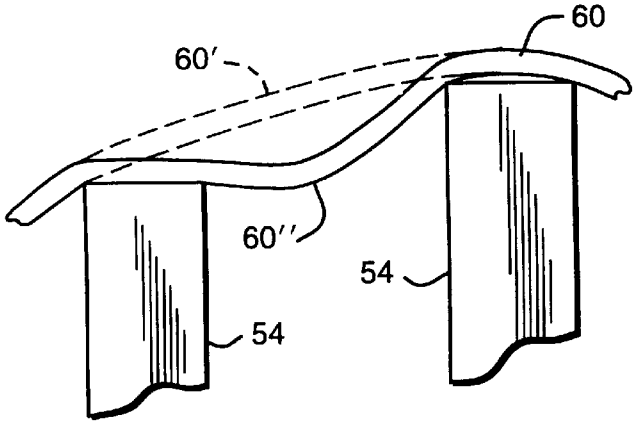
FIG. 5 is an enlarged detailed side elevational cross-sectional view of the cupping of the flexible skin between buoyant foam plates.
Figure 6:
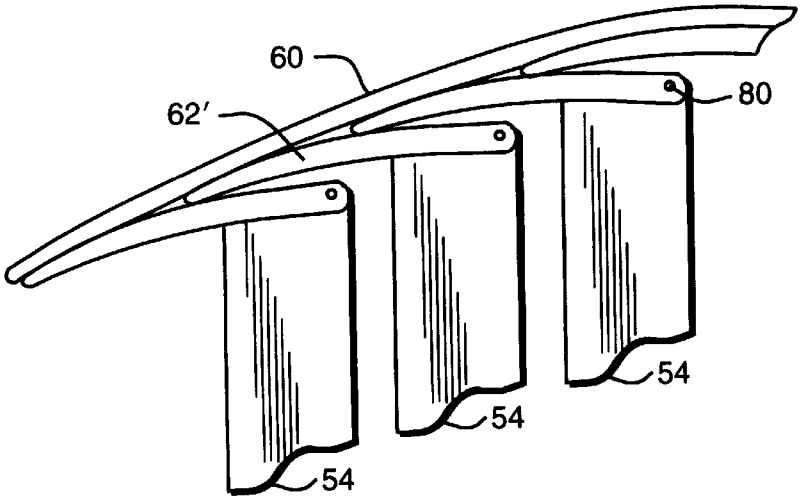
FIG. 6 is a view similar to FIG. 5 showing the introduction of the sliding plates of FIG. 4 to prevent the cupping of the flexible skin.

The use of sliding plate 62 to prevent cupping can better be understood with reference to FIGS. 5 and 6. In FIG. 5 there is shown two buoyant foam plates 54 being spanned by flexible skin 60 which ideally would span the gap between the plates in a smooth fashion as shown in dashed lines 60' but can actually droop or cup to the position shown at 60" to provide an uneven or irregular surface which can be deleterious to the operation of the vehicle. To combat this, sliding plates 62, FIG. 6, are installed so that each sliding plate 62, as shown by plate 62', is fixed at one point 80 to one of the plates 54 and bridges at least a pair of plates. In this way cupping of the flexible skin is prevented.

Figure 7:
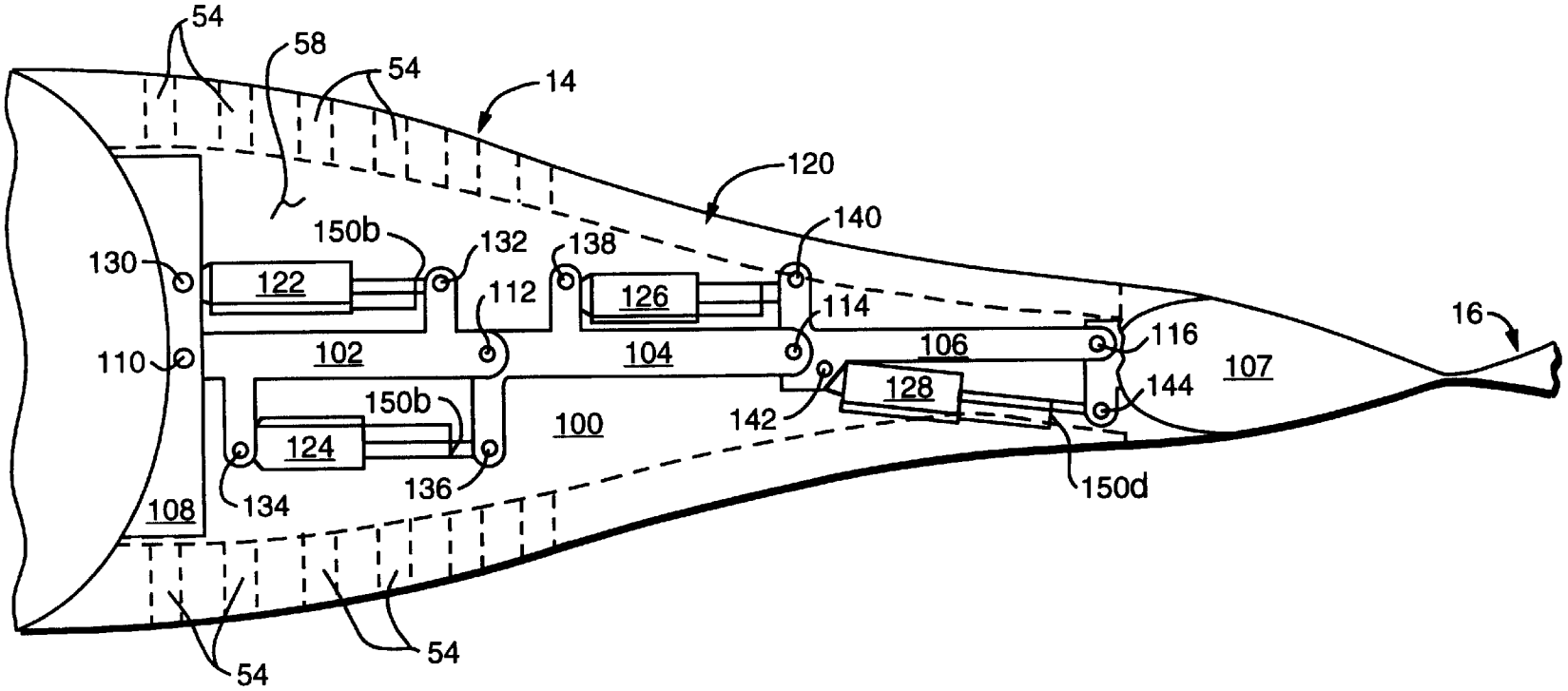
FIG. 7 is a diagrammatic top plan view of afterbody of FIG. 1 with parts broken away to show the structure and drive system for imparting a traveling sinusoidal wave motion to the afterbody.

The articulation of afterbody 14 may be effected by a drive structure 100, FIG. 7, composed of a plurality of pivotally interconnected links 102, 104, 106, 107 interconnected with each other and the base 108 at pivots 110, 112, 114 and 116. Drive structure 120 is driven by drive system 100 which includes hydraulic cylinders 122, 124, 126 and 128. Cylinder 122 is rotatably connected between base 108 and link 102 by pivots 130 and 132; cylinder 124 is interconnected between links 102 and 104 by pivots 134 and 136; cylinder 126 is interconnected between links 104 and 106 by pivots 138 and 140; and cylinder 128 is interconnected between links 106 and 107 by pivots 142 and 144. Each cylinder has associated with it a sensor such as an LVDT 150*a*, 150*b*, 150*c* and 150*d* for detecting its motion.

The length of the forebody is approximately 40–80% of the combined length of the forebody and afterbody and the longitudinal weight distribution of the vehicle follows the longitudinal volume distribution of the vehicle so that the buoyancy is effectively neutral throughout in order to effect a smooth and efficient action. This is shown in FIG. 8E where the longitudinal weight distribution 160 along the length of forebody 12 and afterbody 14 follows closely the longitudinal volume distribution 162 illustrating the neutral buoyancy effect which is generally local throughout the length of the vehicle. That the forebody 12 is 50–70% of the combined forebody and afterbody can be seen by the cumulative volume characteristic 164. FIGS. 8A, B, C and D are cross-sectional views through lines 8A—8A, 8B—8B, 8C—8C and 8D—8D of FIG. 8E depicting the localized construction of the vehicle along the length of the vehicle.

Although in accordance with this invention the forebody is a rigid body, it may include a flexible nose 180, FIG. 9, which is deformable under the forces and pressures to which the vehicle is exposed. Further, flexible nose 180 may be provided with a drive mechanism 182, FIG. 10, in a compartment 184 between the flexible nose 180 and rigid forebody shell 12*a*. Drive mechanism 182 may include a drive structure 184 including a base link 186 connected at pivot 188 to link 190 whose distal end 192 is rounded to rotatably nest in rounded recess 194 on the inside of nose 180. Thus when hydraulic cylinder 196 pivotally interconnected to forebody 12*a* at pivot 198 and to link 190 at pivot 200, link 190 can be rotated to bend the tip 202 of nose 180 to the right or left up or down in FIG. 10.

Figure 11B:
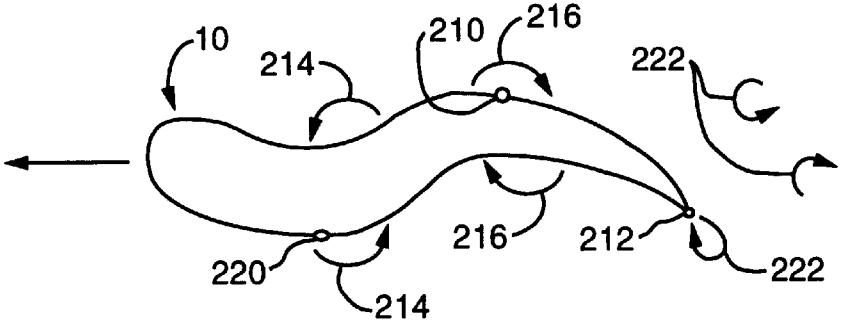

The traveling sinusoidal wave motion which makes the vehicle's propulsion of maneuvering most effective is shown in FIGS. 11A and 11B. In FIG. 11A vehicle 10 has been shaped by the drive structure 100 and drive system 120 into a sinusoidal shape which has a crest at 210 and a trough at 212 creating bounded vorticity as indicated in part at 214 and 216. As the traveling wave motion continues, trough 212 reaches the tail while crest 210 moves toward the tail and the new trough occurs at 220. The bounded vorticity 214, 216 gives rise to independent vortices 222 beginning at the tip of the tail. These vortices, such as those spinning off the end of vehicle 10 in FIG. 11A, create a jet flow or velocity profile 224 as shown in FIG. 11C.

The operation of the structure 100 to create the traveling sinusoidal wave motion alone and in combination with a maneuvering or turning curvature is shown in FIG. 12, where for example in full lines it can be seen that each of the links 102, 104, 106 and 107 have been rotated to assume an angle $\theta_1$, $\theta_2$, $\theta_3$ and $\theta_4$ with respect to its preceding link. Typically these angles may be all the same and in the range of ±20–30°. By varying these angles from +20° or 30° to −20° or 30°, the structure is "wagged", creating the traveling sinusoidal wave motion. This motion may be superimposed on a curved path by simply introducing a maneuvering or steering angle deviation $\phi$ so that the entire series of angles $\theta_1$–$\theta_4$ is superimposed on the structure 100 having been turned or rotated through a maneuvering angle $\phi$.

The operating system to effect these motions is shown in FIG. 13 implemented by a vehicle microprocessor 250 such as a PC 104 which may be a 486 100 MHz microprocessor which operates a power distribution circuit 252 that controls battery or fuel cell 254. Processor 250 commands diving and depth control 253 which in turn operates the pectoral fin actuators 22 and 24. Processor 250 also operates propulsion control 256 and the maneuvering or steering control 258 which drive the propulsion maneuvering waveform scheduler 260 that in turn operates the actuators or hydraulic cylinders 122, 124, 126 and 128 of system 120 and the nose actuator or cylinder 196 of the nose drive mechanism 182. Propulsion/maneuvering waveform scheduler 260 may include comparator 262, FIG. 14, which receives an input from sensors 150*a, b, c* and d indicating the true state of the hydraulic cylinders 122, 124, 126 and 128 at negative input 264. The $\theta$ propulsion command is delivered at 266 and the maneuvering or steering command $\phi$ is provided at input 268. The difference or error signal e is provided on output 270 to a controller such as a proportional integral derivative (PID) control 272 the output of which is delivered to a smoother module 274 to provide more gradual commands to the output actuators 122, 124, 126, 128, and if need be nose actuator 196.

Although thus far the operation of afterbody 14 has been shown as driven by a series of hydraulic cylinders, this is not a necessary limitation of the invention. Artificial muscles 300*a*, 300*b* may be used instead. This can eliminate the need for separate sensors because, since artificial muscles generally operate only in contraction, when the muscles 300*a* on one side are operating in contraction the muscles 300*b* on the other side may be used as sensors in place of sensors 152*a, b, c* and d, for example, to sense the actual position of afterbody 14*b*.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A pelagic autonomous free swimming aquatic vehicle comprising:

a submersible rigid forebody having a predetermined volume, said volume of said forebody is 50%–70% of the envelope displacement of the vehicle;

a water tight chamber in said forebody; and a flexible afterbody having a lesser volume than said forebody and including a maneuvering and propulsion structure and drive system means for driving said structure with a traveling sinusoidal wave motion.

2. The pelagic autonomous free swimming underwater vehicle of claim 1 in which the longitudinal weight distribution follows the longitudinal volume distribution in the vehicle.

3. The pelagic autonomous free swimming underwater vehicle of claim 1 in which said chamber is a pressure hull.

4. The pelagic autonomous free swimming underwater vehicle of claim 1 in which said chamber includes a cargo volume.

5. The pelagic autonomous free swimming underwater vehicle of claim 1 in which said chamber includes an energy source.

6. The pelagic autonomous free swimming underwater vehicle of claim 5 in which said energy source includes a battery.

7. The pelagic autonomous free swimming underwater vehicle of claim 5 in which said energy source includes a fuel cell.

8. The pelagic autonomous free swimming underwater vehicle of claim 5 in which said energy source includes an air independent thermal engine.

9. The pelagic autonomous free swimming underwater vehicle of claim 1 in which said afterbody is neutrally buoyant.

10. the pelagic autonomous free swimming underwater vehicle of claim 1 in which said propulsion structure includes an outer water-impervious medium.

11. The pelagic autonomous free swimming underwater vehicle of claim 1 in which said structure afterbody includes at least one longitudinal element and a plurality of laterally extending elements attached to each said longitudinal element for maintaining a fair contour during bending due to propulsion or maneuvering.

12. The pelagic autonomous free swimming underwater vehicle of claim 11 in which said afterbody includes an intermediate medium between an outer water-impervious medium and said lateral elements for preventing cupping of said outer medium between said lateral sections.

13. The pelagic autonomous free swimming underwater vehicle of claim 1 in which said drive system includes a plurality of sequentially pivotally interconnected limbs and a hydraulic drive means for moving each of said links relative to its adjacent links.

14. The pelagic autonomous free swimming underwater vehicle of claim 1 in which the length of the forebody is 40%–80% of the combined length of the forebody and afterbody.

15. The pelagic autonomous free swimming underwater vehicle of claim 1 further including diving plane means for controlling depth and pitch.

16. The pelagic autonomous free swimming underwater vehicle of claim 15 in which said diving plane means includes a pair of diving planes.

17. The pelagic autonomous free swimming underwater vehicle of claim 1 in which the nose of the forebody is flexible.

18. The pelagic autonomous free swimming underwater vehicle of claim 17 further including a drive mechanism for steering the flexible nose.

19. The pelagic autonomous free swimming underwater vehicle of claim 1 in which said chamber includes a control system having means for directing said drive system to drive said structure with a traveling sinusoidal wave motion.

20. The pelagic autonomous free swimming underwater vehicle of claim 19 in which said control system includes means for directing said drive system to drive said structure to assume a curved shape.

21. A pelagic free swimming aquatic vehicle comprising:

a rigid forebody having a predetermined volume;

a watertight chamber in said forebody;

an energy source in said chamber, said energy source having an independent thermal engine; and a flexible afterbody having a lesser volume than said forebody and including a maneuvering and propulsion structure and drive system for driving said structure with a traveling sinusoidal wave motion.

22. A pelagic free swimming aquatic vehicle comprising:

a rigid forebody having a predetermined volume;

a watertight chamber in said forebody;

a flexible afterbody having a lesser volume than said forebody and including a maneuvering and propulsion structure and drive system for driving said structure with a traveling sinusoidal wave motion, said afterbody including at least one longitudinal element and a plurality of laterally extending elements attached to each said longitudinal element; and an intermediate medium between an outer water-impervious medium and said lateral elements for preventing cupping of said outer medium and said lateral sections.

23. A pelagic free swimming aquatic vehicle comprising:

a rigid forebody having a predetermined volume, said forebody having a flexible nose;

a watertight chamber in said forebody; and a flexible afterbody having a lesser volume than said forebody and including a maneuvering and propulsion structure and drive system for driving said structure with a traveling sinusoidal wave motion.

24. The pelagic free swimming aquatic vehicle of claim 23 further including a drive mechanism for steering said flexible nose.

* * * * *

UNITED STATES PATENT AND TRADEMARK OFFICE

CERTIFICATE OF CORRECTION

PATENT NO.: 6,138,604

DATED: October 31, 2000

INVENTORS: Jamie M. Anderson, Watertown; Peter A. Kerrebrock, Hingham; and Peter W. Sebelius, Chelmsford, all of Massachusetts.

It is certified that error appears in the above-identified patent and that said Letters Patent are hereby corrected as shown below:

in the title, "SWINGING" should be removed and --SWIMMING-- inserted in its place.

Signed and Sealed this

First Day of May, 2001

*Attest:*

Nicholas P. Godici

NICHOLAS P. GODICI

*Attesting Officer*

*Acting Director of the United States Patent and Trademark Office*